US011217135B2

(12) United States Patent
Zhu et al.

(10) Patent No.: US 11,217,135 B2
(45) Date of Patent: Jan. 4, 2022

(54) SCAN DRIVING CIRCUIT AND DRIVING METHOD, DISPLAY DEVICE

(71) Applicants: BOE Technology Group Co., Ltd., Beijing (CN); Hefei Xinsheng Optoelectronics Technology Co., Ltd., Anhui (CN)

(72) Inventors: Sheng Zhu, Beijing (CN); Zhengyuan Zhang, Beijing (CN); Peng Sui, Beijing (CN); Can Yuan, Beijing (CN); Qiao Zhu, Beijing (CN); Qingqiao Jia, Beijing (CN); Pengcheng Yao, Beijing (CN)

(73) Assignees: BOE Technology Group Co., Ltd., Beijing (CN); Hefei Xinsheng Optoelectronics Technology Co., Ltd., Anhui (CN)

( * ) Notice: Subject to any disclaimer, the term of this patent is extended or adjusted under 35 U.S.C. 154(b) by 561 days.

(21) Appl. No.: 16/301,579

(22) PCT Filed: May 16, 2018

(86) PCT No.: PCT/CN2018/087091
§ 371 (c)(1),
(2) Date: Nov. 14, 2018

(87) PCT Pub. No.: WO2019/029216
PCT Pub. Date: Feb. 14, 2019

(65) Prior Publication Data

US 2021/0233446 A1 Jul. 29, 2021

(30) Foreign Application Priority Data

Aug. 8, 2017 (CN) ..... 201710672190.5

(51) Int. Cl.
*G09G 3/00* (2006.01)
*G09G 3/20* (2006.01)

(52) U.S. Cl.
CPC ..... *G09G 3/035* (2020.08); *G09G 3/20* (2013.01); *G09G 2300/0421* (2013.01);
(Continued)

(58) Field of Classification Search
CPC .. G09G 3/035; G09G 3/20; G09G 2300/0421; G09G 2300/08;
(Continued)

(56) References Cited

U.S. PATENT DOCUMENTS 8,471,981 B2 6/2013 Kim et al.
9,646,525 B2 5/2017 Kim et al.
(Continued)

FOREIGN PATENT DOCUMENTS

CN 1645450 A 7/2005
CN 103399684 A 11/2013
(Continued)

OTHER PUBLICATIONS

Aug. 9, 2018—(WO) International Search Report and the Written Opinion Appn PCT/CN2018/087091 with English Translation.
(Continued)

*Primary Examiner* — Charles V Hicks
(74) *Attorney, Agent, or Firm* — Banner & Witcoff, Ltd.

(57) ABSTRACT

A scan driving circuit, a driving method, and a display device is provided. The scan driving circuit includes a first scan unit, a first scan line, a first control circuit, and a first switching circuit. The first scan unit includes a first output terminal configured to output a first scan signal. The first control circuit is connected to the first switching circuit, and the first control circuit is configured to control turn-on or turn-off of the first switching circuit under control of the first
(Continued)

control signal. The first scan line is connected to the first output terminal through the first switching circuit, so that the first output terminal is electrically connected to the first scan line when the first switching circuit is turned on.

20 Claims, 11 Drawing Sheets

(52) U.S. Cl.
CPC . *G09G 2300/08* (2013.01); *G09G 2310/0202* (2013.01); *G09G 2310/0243* (2013.01); *G09G 2310/0267* (2013.01); *G09G 2310/0286* (2013.01); *G09G 2330/021* (2013.01)

(58) Field of Classification Search
CPC ... G09G 2310/0202; G09G 2310/0243; G09G 2310/0267; G09G 2310/0286; G09G 2330/021
See application file for complete search history.

(56) References Cited

U.S. PATENT DOCUMENTS

| | | | | |
|---|---|---|---|---|
| 9,805,659 | B2 | 10/2017 | Ikeda et al. | |
| 10,255,863 | B2 | 4/2019 | Song et al. | |
| 10,671,193 | B2 | 6/2020 | Won | |
| 2003/0090614 | A1* | 5/2003 | Kim | G11C 19/28 349/149 |
| 2005/0151830 | A1 | 7/2005 | Yamazaki | |
| 2015/0287365 | A1* | 10/2015 | Song | G09G 3/3208 345/206 |
| 2015/0348508 | A1* | 12/2015 | Her | G09G 5/18 345/205 |
| 2016/0246331 | A1 | 8/2016 | Cho | |
| 2017/0069290 | A1 | 3/2017 | Lee et al. | |
| 2018/0088654 | A1 | 3/2018 | Liu | |
| 2018/0233091 | A1 | 8/2018 | Ma | |

FOREIGN PATENT DOCUMENTS

| | | | |
|---|---|---|---|
| CN | 103927092 | A | 7/2014 |
| CN | 104916249 | A | 9/2015 |
| CN | 104978899 | A | 10/2015 |
| CN | 105511562 | A | 4/2016 |
| CN | 105702193 | A | 6/2016 |
| CN | 105976759 | A | 9/2016 |
| CN | 106057855 | A | 10/2016 |
| CN | 106128351 | A | 11/2016 |
| CN | 106328081 | A | 1/2017 |
| CN | 106355995 | A | 1/2017 |
| JP | H10186396 | A | 7/1998 |
| KR | 20120088971 | A | 8/2012 |
| KR | 20160032099 | A | 3/2016 |

OTHER PUBLICATIONS

Dec. 26, 2019—(CN) Office Action application 20171067219.0 with English Translation.
Dec. 3, 2019—(KR) Office Action application 10-2019-7034901 with English Translation.
Jun. 23, 2020—(CN) Second Office Action Appn 201710672190.5 with English Translation.

* cited by examiner

SCAN DRIVING CIRCUIT AND DRIVING METHOD, DISPLAY DEVICE

The application is a U.S. National Phase Entry of International Application No. PCT/CN2018/087091 filed on May 16, 2018, designating the United States of America and claiming priority to Chinese Patent Application No. 201710672190.5, filed on Aug. 8, 2017. The present application claims priority to and the benefit of the above-identified applications and the above-identified applications are incorporated by reference herein in their entirety.

TECHNICAL FIELD

The embodiments of the present disclosure relate to a scan driving circuit, a driving method, and a display device.

BACKGROUND

Foldable display technology is a new and popular technology in a field of display technology, and enables display devices no longer to be subject to space constraints. However, at present, there are many technical problems in foldable display devices, such as single folding display mode and high power consumption of display by area, and all the technical problems become thorny problems in the field.

SUMMARY

At least one embodiment of the present disclosure discloses provides a scan driving circuit, which comprises a first scan unit, a first scan line, a first control circuit, and a first switching circuit. The first scan unit comprises a first output terminal configured to output a first scan signal; the first control circuit is connected to the first switching circuit, and the first control circuit is configured to control turn-on or turn-off of the first switching circuit under control of a first control signal; and the first scan line is connected to the first output terminal through the first switching circuit, so that the first output terminal is electrically connected to the first scan line when the first switching circuit is turned on.

For example, in the scan driving circuit provided by an embodiment of the present disclosure, the first switching circuit comprises a first switching transistor, a first electrode of the first switching transistor is connected to the first output terminal, and a second electrode of the first switching transistor is connected to the first scan line; and the first control circuit comprises a first control transistor, a first electrode of the first control transistor is connected to a signal input terminal, a second electrode of the first control transistor is connected to a gate electrode of the first switching transistor, and a gate electrode of the first control transistor is connected to a first control terminal to receive the first control signal.

For example, the scan driving circuit provided by an embodiment of the present disclosure further comprises a second scan line, a second control circuit, and a second switching circuit. The first scan unit further comprises a second output terminal configured to output a second scan signal; the second control circuit is connected to the second switching circuit, and the second control circuit is configured to control turn-on or turn-off of the second switching circuit under control of a second control signal; and the second scan line is connected to the second output terminal through the second switching circuit, so that the second output terminal is electrically connected to the second scan line when the second switching circuit is turned on.

For example, in the scan driving circuit provided by an embodiment of the present disclosure, the second switching circuit comprises a second switching transistor, a first electrode of the second switching transistor is connected to the second output terminal, and a second electrode of the second switching transistor is connected to the second scan line; and the second control circuit comprises a second control transistor, a first electrode of the second control transistor is connected to a signal input terminal, a second electrode of the second control transistor is connected to a gate electrode of the second switching transistor, and a gate electrode of the second control transistor is connected to a second control terminal for receiving the second control signal.

For example, the scan driving circuit provided by an embodiment of the present disclosure further comprises a second scan unit, a third scan line, and a third switching circuit. The second scan unit comprises a third output terminal configured to output a third scan signal; the first control circuit is connected to the third switching circuit, and the first control circuit is configured to control turn-on or turn-off of the third switching circuit under control of the first control signal; and the third scan line is connected to the third output terminal through the third switching circuit, so that the third output terminal is electrically connected to the third scan line when the third switching circuit is turned on.

For example, in the scan driving circuit provided by an embodiment of the present disclosure, the first scan line and the third scan line correspond to a first display area, and the first control signal is used to control a scanning operation of the first display area.

For example, in the scan driving circuit provided by an embodiment of the present disclosure, the first scan unit and the second scan unit are cascaded shift registers.

For example, the scan driving circuit provided by an embodiment of the present disclosure further comprises a fourth scan line and a fourth switching circuit. The second scan unit further comprises a fourth output terminal configured to output a fourth scan signal; the second control circuit is connected to the fourth switching circuit, and the second control circuit is configured to control turn-on or turn-off of the fourth switching circuit under control of a second control signal; and the fourth scan line is connected to the fourth output terminal through the fourth switching circuit, so that the fourth output terminal is electrically connected to the fourth scan line when the fourth switching circuit is turned on.

For example, in the scan driving circuit provided by an embodiment of the present disclosure, the second scan line and the fourth scan line correspond to a second display area, and the second control signal is used to control a scanning operation of the second display area.

For example, the scan driving circuit provided by an embodiment of the present disclosure further comprises a third scan unit, a third control circuit, and a fifth switching circuit. The third scan unit comprises a fifth output terminal configured to output a fifth scan signal, and the fifth scan signal is identical to the first scan signal; the third control circuit is connected to the fifth switching circuit, and the third control circuit is configured to receive the first control signal and control turn-on or turn-off of the fifth switching circuit under control of the first control signal; and the first scan line is connected to the fifth output terminal through the fifth switching circuit, so that the fifth output terminal is electrically connected to the first scan line when the fifth switching circuit is turned on.

For example, the scan driving circuit provided by an embodiment of the present disclosure further comprises a fifth scan line, a fourth control circuit, and a sixth switching circuit. The third scan unit further comprises a sixth output terminal configured to output a sixth scan signal; the fourth control circuit is connected to the sixth switching circuit, and the fourth control circuit is configured to control turn-on or turn-off of the sixth switching circuit under control of a third control signal; and the fifth scan line is connected to the sixth output terminal through the sixth switching circuit, so that the sixth output terminal is electrically connected to the fifth scan line when the sixth switching circuit is turned on.

For example, the scan driving circuit provided by an embodiment of the present disclosure further comprises a fourth scan unit and a seventh switching circuit. The fourth scan unit comprises a seventh output terminal configured to output a seventh scan signal, the seventh scan signal is identical to the third scan signal; the third control circuit is connected to the seventh switching circuit, and the third control circuit is configured to control turn-on or turn-off of the seventh switching circuit under control of the first control signal; and the third scan line is connected to the seventh output terminal through the seventh switching circuit, so that the seventh output terminal is electrically connected to the third scan line when the seventh switching circuit is turned on.

For example, in the scan driving circuit provided by an embodiment of the present disclosure, the third scan unit and the fourth scan unit are cascaded shift registers.

For example, the scan driving circuit provided by an embodiment of the present disclosure further comprises a sixth scan line and an eighth switching circuit. The fourth scan unit further comprises an eighth output terminal configured to output an eighth scan signal; the fourth control circuit is connected to the eighth switching circuit, and the fourth control circuit controls turn-on or turn-off of the eighth switching circuit under control of a third control signal; and the sixth scan line is connected to the eighth output terminal through the eighth switching circuit, so that the eighth output terminal is electrically connected to the sixth scan line when the eighth switching circuit is turned on.

For example, in the scan driving circuit provided by an embodiment of the present disclosure, the fifth scan line and the sixth scan line correspond to a third display area, and the third control signal is used to control a scanning operation of the third display area.

At least one embodiment of the present disclosure discloses further provides a display device comprising a display panel and the scan driving circuit according to any one of the embodiments of the present disclosure.

For example, the display device provided by an embodiment of the present disclosure further comprises a sensor for determining a folded state of the display device. The sensor is configured to generate a control signal for controlling a scanning operation of the display panel according to the folded state of the display device.

For example, in the display device provided by an embodiment of the present disclosure, the scan driving circuit is in a folded region of the display panel.

At least one embodiment of the present disclosure discloses further provides a method for driving the scan driving circuit, which comprises: controlling the first switching circuit and the third switching circuit to be turned on under control of the first control signal; controlling a second switching circuit and the fourth switching circuit to be turned on under control of the second control signal; at first scan time: generating the first scan signal and a second scan signal; and outputting the first scan signal to the first scan line via the first switching circuit, and outputting the second scan signal to a second scan line via the second switching circuit; and at second scan time: generating the third scan signal and the fourth scan signal; and outputting the third scan signal to the third scan line via the third switching circuit, and outputting the fourth scan signal to the fourth scan line via the fourth switching circuit.

At least one embodiment of the present disclosure discloses further provides a method for driving the scan driving circuit, which comprises: controlling the first switching circuit, the third switching circuit, the fifth switching circuit, and the seventh switching circuit to be turned on under control of the first control signal; controlling a second switching circuit and a fourth switching circuit to be turned on under control of a second control signal; controlling a sixth switching circuit and the eighth switching circuit to be turned on under control of the third control signal; at first scan time: generating the first scan signal, a second scan signal, the fifth scan signal, and a sixth scan signal; and outputting the first scan signal to the first scan line via the first switching circuit, and outputting the fifth scan signal to the first scan line via the fifth switching circuit, outputting the second scan signal to a second scan line via the second switching circuit, and outputting the sixth scan signal to a fifth scan line via the sixth switching circuit; and at second scan time: generating the third scan signal, a fourth scan signal, the seventh scan signal, and the eighth scan signal; and outputting the third scan signal to the third scan line via the third switching circuit, and outputting the seventh scan signal to the third scan line via the seventh switching circuit, outputting the fourth scan signal to a fourth scan line via the fourth switching circuit, and outputting the eighth scan signal to the sixth scan line via the eighth switching circuit.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1:
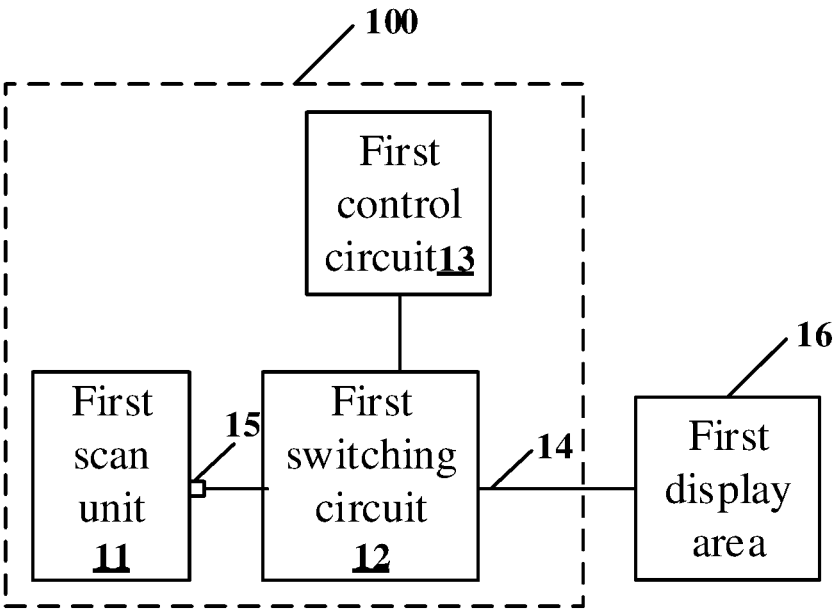
FIG. 1 is a schematic diagram of a scan driving circuit provided by an example of an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "Upper", "lower", "left", "right", etc. are only used to indicate the relative positional relationship, and when the absolute position of the object to be described is changed, the relative positional relationship may also change accordingly.

At least one embodiment of the present disclosure provides a scan driving circuit. The scan driving circuit comprises a first scan unit, a first scan line, a first control circuit, and a first switching circuit. The first scan unit comprises a first output terminal configured to output a first scan signal, the first control circuit is connected to the first switching circuit, and the first control circuit is configured to control turn-on or turn-off of the first switching circuit under control of a first control signal, and the first scan line is connected to the first output terminal through the first switching circuit, so that the first output terminal is electrically connected to the first scan line when the first switching circuit is turned on. At least one embodiment of the present disclosure further provides a method for driving the above-described scan driving circuit and a display device.

A conventional foldable display device has some problems, such as a single display mode and generating useless power consumption when displaying by area. The scan driving circuit, the method for driving the scan driving circuit and the display device provided by the embodiments of the present disclosure can respectively control scanning operations of a plurality of display areas of the display device according to a control signal (for example, a control signal generated by a sensor), so as to achieve to display by area according to requirements, thereby reducing power consumption.

Embodiments of the present disclosure will be described in detail below with reference to the accompanying drawings.

An example of an embodiment of the present disclosure provides a scan driving circuit 100, as shown in FIG. 1, the scan driving circuit 100 comprises a first scan unit 11, a first scan line 14, a first control circuit 13, and a first switching circuit 12.

The first scan unit 11 comprises a first output terminal 15 configured to output a first scan signal. The first control circuit 13 is connected to the first switching circuit 12, and the first control circuit 13 is configured to control turn-on or turn-off of the first switching circuit 12 under control of a first control signal. The first scan line 14 is connected to the first output terminal 15 through the first switching circuit 12, so that the first output terminal 15 is electrically connected to the first scan line 14 when the first switching circuit 12 is turned on.

For example, in a case where the scan driving circuit 100 is used for scan driving a display device, the first scan line 14 may be connected to a plurality of pixel units in a first display area 16 of the display device. For example, the first scan line 14 may be connected to pixel units in a row in the first display area 16, and is used for driving the pixel units in the row to implement a display function.

Figure 12:
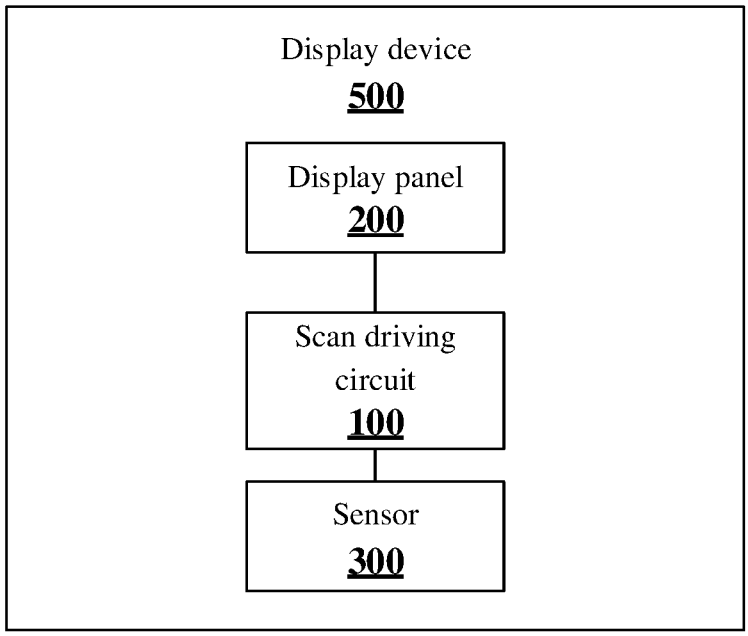
FIG. 12 is a schematic diagram 1 of a display device provided by an embodiment of the present disclosure.

For example, the first control signal can be used to control the display of the first display area 16. For example, the first control signal can be generated by a sensor 300 as shown in FIG. 12.

In the embodiment of the present disclosure, when the first display area 16 needs to be display, the first control circuit controls the first switching circuit to be turned on, and the first scan unit outputs the first scan signal to the first display area for driving a corresponding pixel unit in the first display area to achieve to display; when the first display area 16 does not need to be display, the first control circuit controls the first switching circuit to be turned off, and the first scan signal output by the first scan unit cannot be transmitted to the first display area, so that the corresponding pixel unit in the first display area cannot be driven to achieve to display, thereby reducing power consumption.

Figure 2:
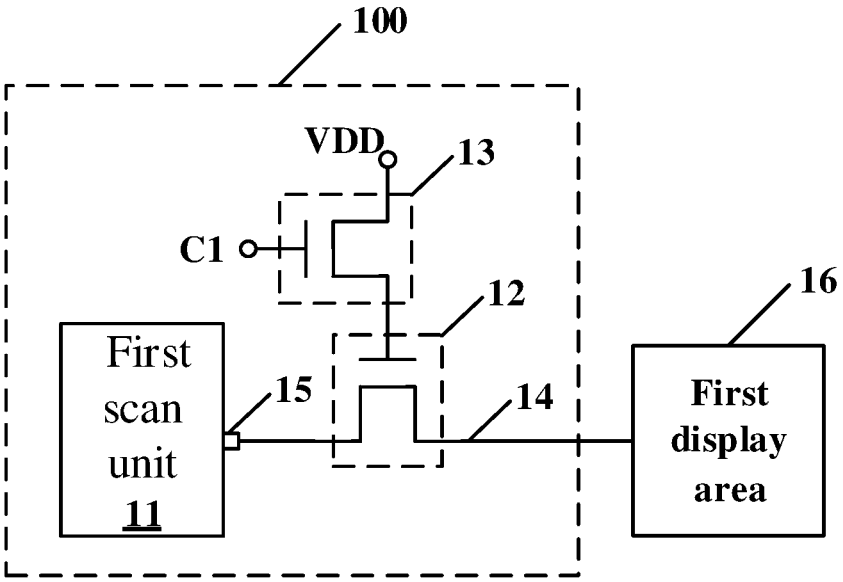
FIG. 2 is an example of a circuit diagram corresponding to the scan driving circuit as shown in FIG. 1.

For example, in an example, as shown in FIG. 2, the first switching circuit 12 includes a first switching transistor, a first electrode of the first switching transistor is connected to the first output terminal 15, and a second electrode of the first switching transistor is connected to the first scan line 14.

The first control circuit 13 comprises a first control transistor, and a first electrode of the first control transistor is connected to a signal input terminal VDD. For example, the signal input terminal VDD can input a power supply voltage. A second electrode of the first control transistor is connected to a gate electrode of the first switching transistor, and a gate electrode of the first control transistor is connected to a first control terminal C1 to receive the first control signal. For example, the first control terminal C1 can be connected to the sensor 300 as shown in FIG. 12 for receiving the first control signal.

It should be noted that in some embodiments, the first control circuit 13 may also only comprise the first control terminal C1 (not comprising the first control transistor). The first control terminal C1 is configured to implement that the gate electrode of the first switching transistor is directly connected to the sensor 300, so that the first control signal generated by the sensor 300 can be directly input to the gate electrode of the first switching transistor to achieve to control the turn-on and turn-off of the first switching transistor.

It should be noted that each of the transistors used in the embodiments of the present disclosure may be a thin film transistor or a field effect transistor or other switching devices having the same characteristics. A source electrode and a drain electrode of the transistor used here can be symmetrical in structure, so the source electrode and the drain electrode of the transistor can be structurally indistinguishable. In the embodiment of the present disclosure, in order to distinguish the two electrodes of the transistor except the gate electrode, one of the two electrodes is directly described as the first electrode and the other electrode is the second electrode, so the first electrode and second electrode of all or a portion of the transistors in the embodiments of the present disclosure are interchangeable as needed. For example, the first electrode of the transistor described in the embodiment of the present disclosure may be a source electrode, and the second electrode may be a drain electrode; alternatively, the first electrode of the transistor is a drain electrode and the second electrode may be a source electrode.

In addition, transistors may be divided into N-type transistors and P-type transistors according to the characteristics of the transistors. When the transistor is a P-type transistor, a turn-on voltage is a low level voltage (e.g, 0V, −5V, −10V, or other suitable voltage), and a turn-off voltage is a high level voltage (e.g, 5V, 10V, or other suitable voltage); when the transistor is an N-type transistor, a turn-on voltage is a high level voltage (e.g, 5V, 10V, or other suitable voltage), and a turn-off voltage is a low level voltage (e.g, 0V, −5V, −10V, or other suitable voltage). The transistors in the embodiments of the present disclosure are all described by taking an N-type transistor as an example. Based on the description and the teaching of the implementation of the disclosure, those skilled in the art can easily obtain that the embodiments of the present disclosure may also adopt an implementation including only the P-type transistors or an implementation of a combination of the N-type transistor and the P-type transistor without making creative efforts, so these implementations are also within a scope of the present disclosure.

Figure 3:
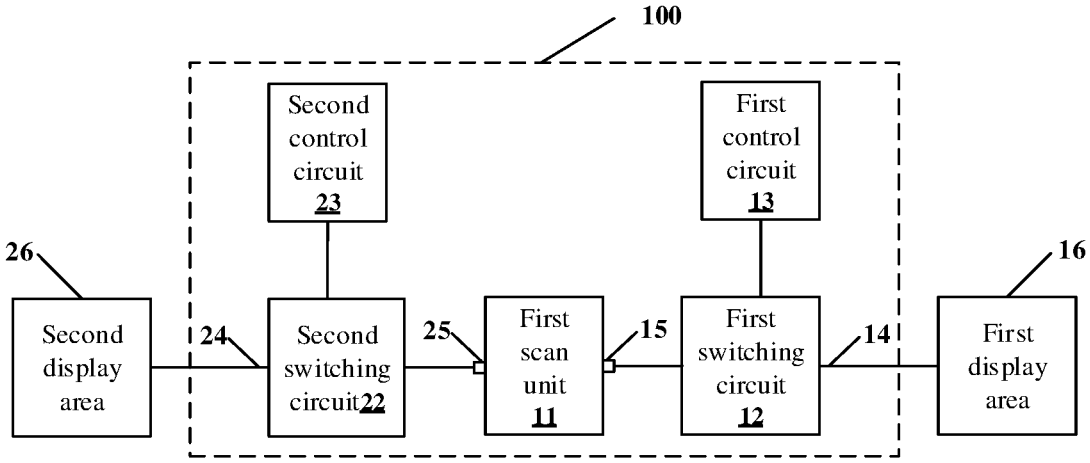
FIG. 3 is a schematic diagram of a scan driving circuit provided by another example of an embodiment of the present disclosure.

For example, in another example of an embodiment of the present disclosure, as shown in FIG. 3, the scan driving circuit 100 may further comprise a second scan line 24, a second control circuit 23, and a second switching circuit 22. The first scan unit 11 further comprises a second output terminal 25 configured to output a second scan signal. The second control circuit 23 is connected to the second switching circuit 22, and the second control circuit 23 is configured to control turn-on or turn-off of the second switching circuit 22 under control of a second control signal. The second scan line 24 is connected to the second output terminal 25 though the second switching circuit 22, so that the second output terminal 25 is electrically connected to the second scan line 24 when the second switching circuit 22 is turned on.

For example, the second scan line 24 can be connected to a plurality of pixel units in a second display area 26 of the display device. For example, the second scan line 24 may be connected to pixel units in a row in the second display area 26, and is used for driving the pixel unit in the row to achieve a display function.

When the first display area 16 needs to display, the first control circuit 13 controls the first switching circuit 12 to be turned on, and the first scan unit 11 outputs the first scan signal to the first display area 16 for driving a corresponding pixel unit in the first display area 16 to achieve to display; when the second display area 26 needs to display, the second control circuit 23 controls the second switching circuit 22 to be turned on, and the first scan unit 11 outputs the second scan signal to the second display area 26 for driving a corresponding pixel unit in the second display area 26 to achieve to display. Therefore, displaying can be achieved by area according to requirements, thereby reducing power consumption. For example, the first display area 16 and the second display area 26 may display separately or simultaneously.

For example, the second control signal can be used to control the display of the second display area 26. For example, the second control signal can be generated by the sensor 300 as shown in FIG. 12.

Figure 4:
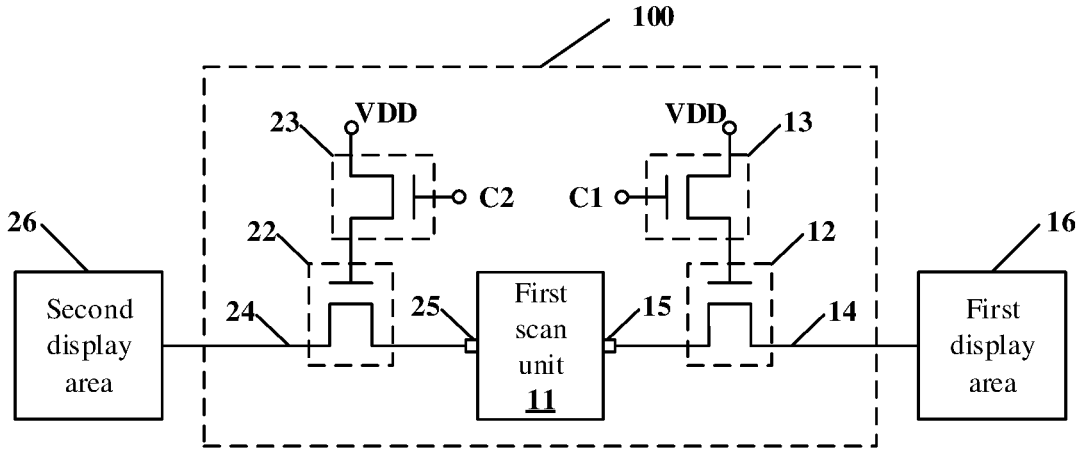
FIG. 4 is an example of a circuit diagram corresponding to the scan driving circuit as shown in FIG. 3.

For example, in an example, as shown in FIG. 4, the second switching circuit 22 comprises a second switching transistor, a first electrode of the second switching transistor is connected to the second output terminal 25, and a second electrode of the second switching transistor is connected to the second scan line 24.

The second control circuit 23 comprises a second control transistor, a first electrode of the second control transistor is connected to the signal input terminal VDD, a second electrode of the second control transistor is connected to a gate electrode of the second switching transistor, and a gate electrode of the second control transistor is connected to a second control terminal C2 for receiving the second control signal. For example, the second control terminal C2 can be connected to the sensor 300 for receiving the second control signal.

It should be noted that in some embodiments, the second control circuit 23 may also only comprise the second control terminal C2 (not comprising the second control transistor). The second control terminal C2 is configured to implement that the gate electrode of the second switching transistor is electrically connected to the sensor 300, so that the second control signal generated by the sensor 300 can be directly input to the gate electrode of the second switching transistor to achieve to control the turn-on and turn-off of the second switching transistor.

Figure 5:
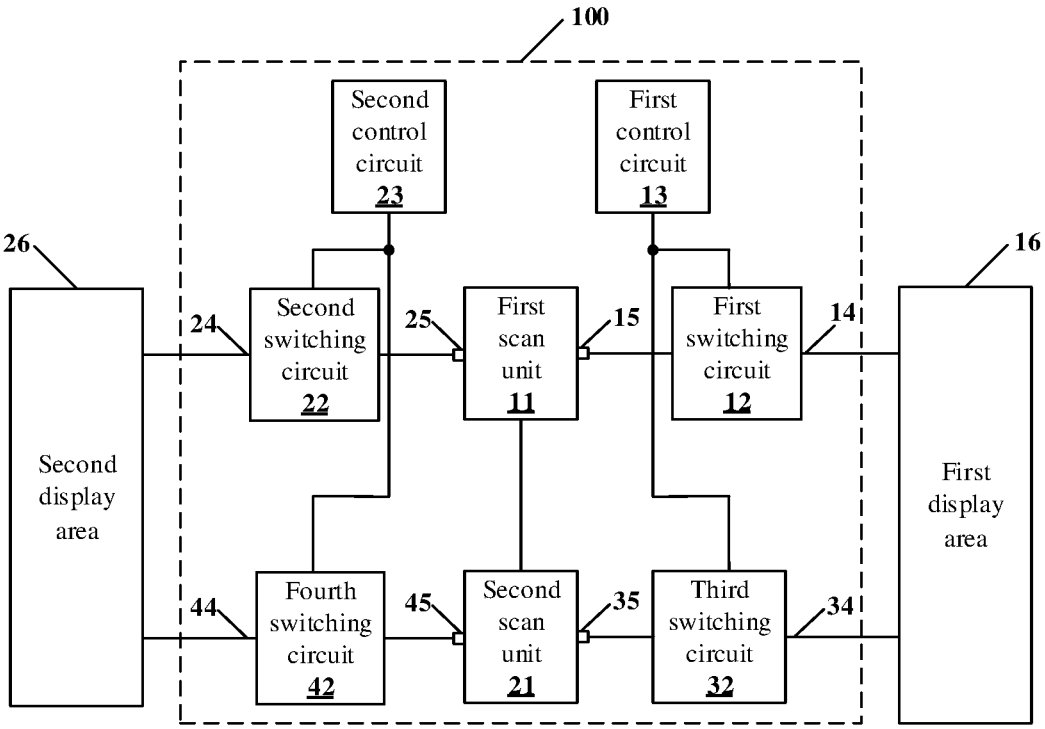
FIG. 5 is a schematic diagram of a scan driving circuit provided by still another example in an embodiment of the present disclosure.

For example, in another example of an embodiment of the present disclosure, as shown in FIG. 5, the scan driving circuit 100 provided in this example may further comprise a second scan unit 21, a third scan line 34, and a third switching circuit 32.

The second scan unit 21 comprises a third output terminal 35 configured to output a third scan signal. The first control circuit 13 is connected to the third switching circuit 32, and the first control circuit 13 is configured to control turn-on or turn-off of the third switching circuit 32 under control of the first control signal. The third scan line 34 is connected to the third output terminal 35 though the third switching circuit 32, so that the third output terminal 35 is electrically connected to the third scan line 34 when the third switching circuit 32 is turned on.

For example, the third scan line 34 can be connected to a plurality of pixel units in the first display area 16 of the display device. For example, the third scan line 34 may be connected to pixel units in a row in the first display area 16 for driving the pixel units in the row to achieve the display.

For example, the scan driving circuit 100 may further comprise a fourth scan line 44 and a fourth switching circuit 42. The second scan unit 21 further comprises a fourth output terminal 45 configured to output a fourth scan signal. The second control circuit 23 is connected to the fourth switching circuit 42, and the second control circuit 23 is configured to control turn-on or turn-off of the fourth switching circuit 42 under the control of the second control signal. The fourth scan line 44 is connected to the fourth output terminal 45 through the fourth switching circuit 42, so that the fourth output terminal 45 is electrically connected to the fourth scan line 44 when the fourth switching circuit 42 is turned on.

Figure 6:
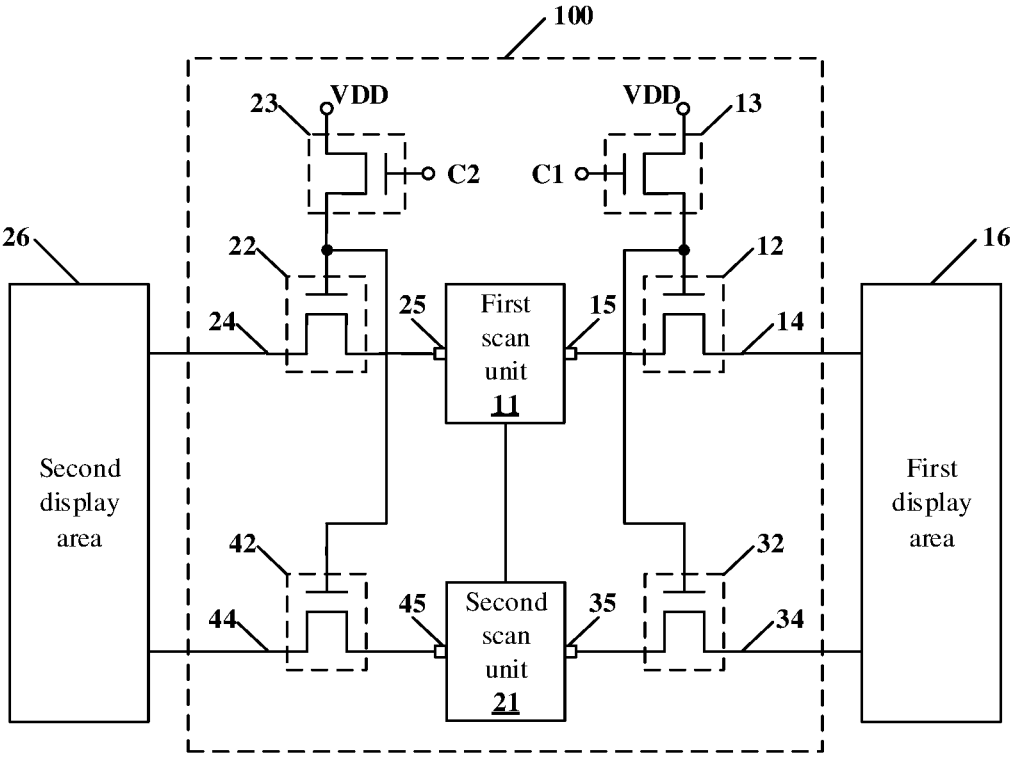
FIG. 6 is an example of a circuit diagram corresponding to the scan driving circuit as shown in FIG. 5.

For example, as shown in FIG. 6, the third switching circuit 32 can be implemented by a transistor, and the setting manner of the third switching circuit 32 can refer to the first switching circuit 12; the fourth switching circuit 42 can be implemented by a transistor, and the setting manner of the fourth switching circuit 42 can refer to the second switching circuit 22. The repetitions are not repeated here.

For example, as shown in FIGS. 5 and 6, the first scan line 14 and the third scan line 34 correspond to the first display area 16, that is, the first scan line 14 and the third scan line 34 are respectively connected to two rows of pixel units in the first display area 16, and are respectively used to drive pixel units in a corresponding row to implement a display function. The second scan line 24 and the fourth scan line 44 correspond to the second display area 26, that is, the second scan line 24 and the fourth scan line 44 are respectively connected to two rows of pixel units in the second display area 26, and are respectively used to drive pixel units in a corresponding row to implement a display function.

For example, when a display operation is only performed on the first display area 16, the first scan unit 11 outputs the first scan signal at first scan time, and the second scan unit 21 outputs the third scan signal at second scan time. The first control circuit 13 controls the conduction of the first switching circuit 12 and the third switching circuit 32 under the control of the first control signal, so that the first scan signal and the third scan signal can be transmitted to the first display area 16 via the first scan line 14 and the third scan line 34, respectively. When the scan circuit 100 comprises a plurality of scan units that are cascaded together, the working principle of the scan units is deduced by analogy, and details are not described herein again. Therefore, the progressive scan display of the first display area 16 can be achieved.

When the display operation is only performed on the second display area 26, the first scan unit 11 outputs the second scan signal at the first scan time, and the second scan unit 21 outputs the fourth scan signal at the second scan time. The second control circuit 23 controls the conduction of the second switching circuit 22 and the fourth switching circuit 42 under the control of the second control signal, so that the second scan signal and the fourth scan signal can be transmitted to the second display area 26 via the second scan line 24 and the fourth scan line 44, respectively. When the scan circuit 100 comprises a plurality of scan units that are cascaded together, the working principle of the scan units is deduced by analogy, and details are not described herein again. Therefore, the progressive scan display of the second display area 26 can be achieved.

When the display operation is performed on the first display area 16 and the second display area 26 simultaneously, the first scan unit 11 outputs the first scan signal and the second scan signal at the first scan time, and the second scan unit 21 outputs the third scan signal and the fourth scan signal at the second scan time. The first control circuit 13 controls the conduction of the first switching circuit 12 and the third switching circuit 32 under the control of the first control signal, and the second control circuit 23 controls the conduction of the second switching circuit 22 and the fourth switching circuit 42 under the control of the second control signal. Therefore, at the first scan time, the first scan signal and the second scan signal may be transmitted to pixel units in a first row of the first display area 16 and pixel units in a first row of the second display area 26 via the first scan line 14 and the second scan line 24, respectively; at the second scan time, the third scan signal and the fourth scan signal may be transmitted to pixel units in a second row of the first display area 16 and pixel units in a second row of the second display area 26 via the third scan line 34 and the fourth scan line 44, respectively. When the scan circuit 100 comprises a plurality of scan units that are cascaded together, the working principle of the scan units is deduced by analogy, and details are not described herein again. Therefore, the progressive scan display of the first display area 16 and the progressive scan display of the second display area 26 can be simultaneously performed.

It should be noted that, in the scan driving circuit 100 as shown in FIG. 5 and FIG. 6, more scan units and their corresponding switching circuits and scan lines may be comprised. The embodiment of the present disclosure does not limit this, and the number of scan units, the number of corresponding switching circuits of the scan units and the number of corresponding scanning lines of the scan units may be specifically set according to the size of the display area.

Figure 7:
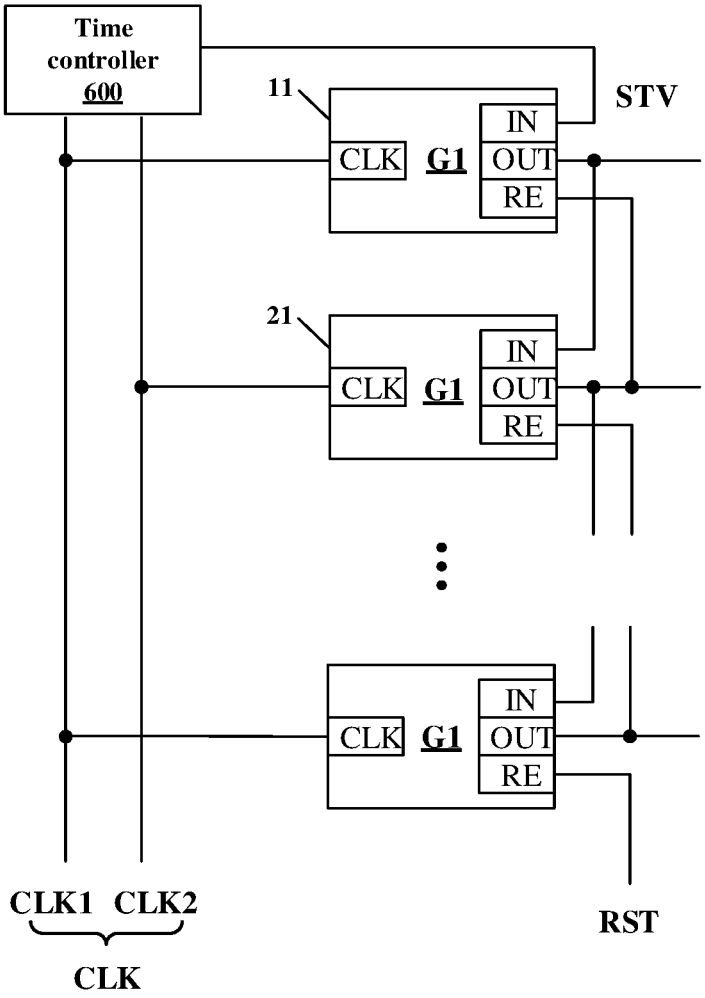
FIG. 7 is a cascade schematic diagram of a plurality of scan units.

For example, in an example, as shown in FIG. 7, the first scan unit 11 and the second scan unit 21 may be shift registers G1, which are cascaded together. It is easily understood that when the scan driving circuit comprises a plurality of scan units, the plurality of scan units may be a plurality of cascaded shift registers G1. The plurality of cascaded shift registers G1 can be directly integrated on the array substrate by the same process as the thin film transistor (TFT) to achieve the progressive scan driving function. The present disclosure does not limit the number of the scan units (i.e, the number of the shift registers) here.

For example, as shown in FIG. 7, except for a first stage and a last stage, an input terminal IN of a shift register G1 in a current stage is connected to an output terminal OUT of a shift register G1 in a previous stage. Except for the first stage and the last stage, a reset terminal RE of the shift register G1 in the current stage is connected to an output terminal OUT of a shift register G1 in a next stage. An input terminal IN of a shift register G1 in the first stage is configured to receive a trigger signal STV. A reset terminal RE of a shift register G1 in the last stage is configured to receive a reset signal RST.

For example, as shown in FIG. 7, a shift register G1 in each stage is configured to output a corresponding scan signal in response to a clock signal CLK. The clock signal CLK includes different clock signals such as a clock signal CLK1 and a clock signal CLK2.

For example, as shown in FIG. 7, the scan driving circuit further comprises a time controller 600. The time controller 600 is configured to provide a clock signal CLK to the shift register G1 in each stage, and the time controller 600 can also be configured to provide the trigger signal STV and the reset signal RST.

It should be noted that the embodiments of the present disclosure comprise, but are not limited to, the situation as shown in FIG. 7, the time controller 600 may also be configured to provide four different clock signals to the shift registers G1 in each stage via four clock signal lines, and the embodiments of the present disclosure are not limited thereto.

Figure 8:
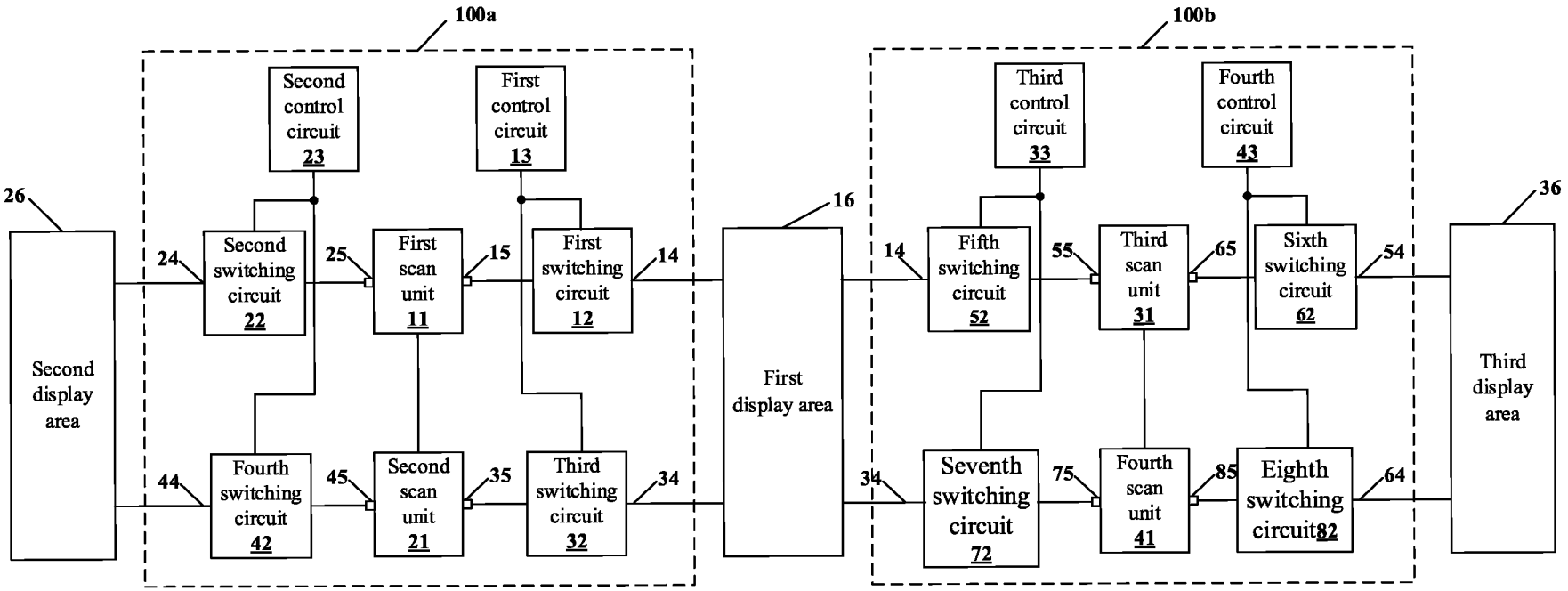
FIG. 8 is a schematic diagram of a scan driving circuit provided by still another example in an embodiment of the present disclosure.
Figure 9:
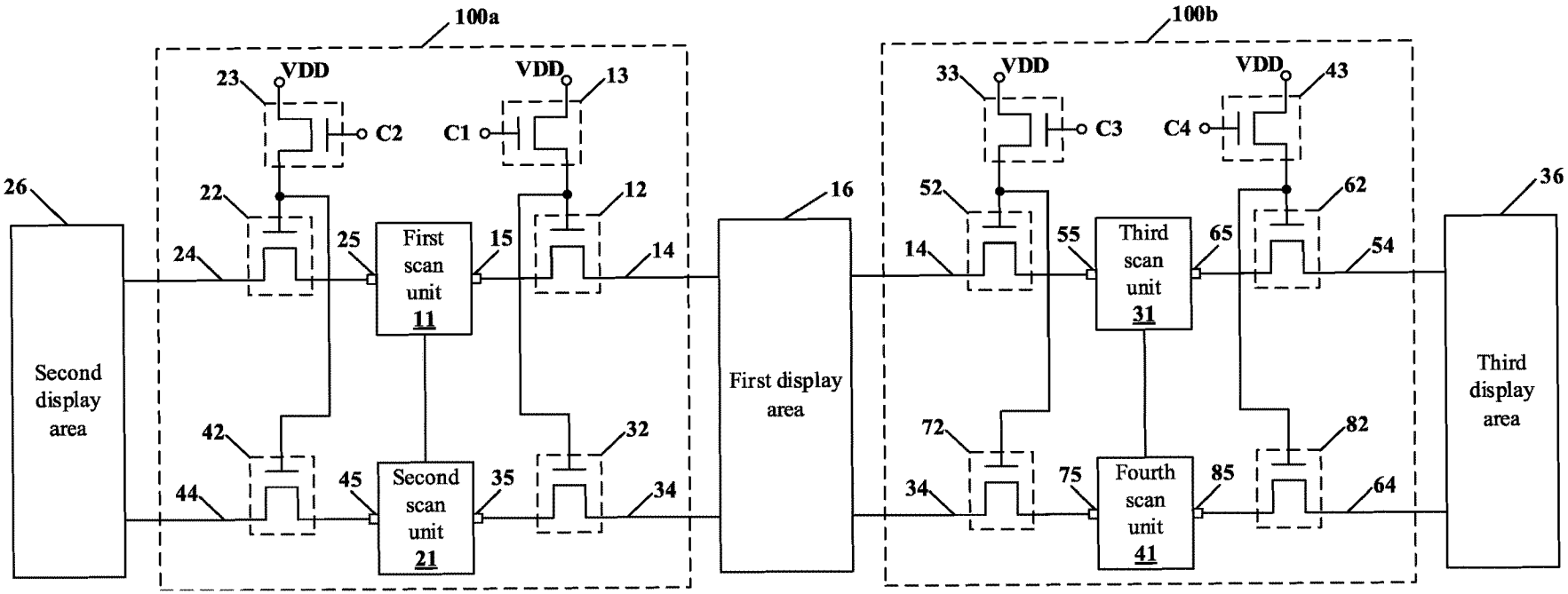
FIG. 9 is an example of a circuit diagram corresponding to the scan driving circuit as shown in FIG. 8.

For example, in another example of an embodiment of the present disclosure, as shown in FIGS. 8 and 9 (FIG. 9 is an example of the circuit diagram of FIG. 8), the scan driving circuit comprises a scan driving circuit 100*a* and a scan driving circuit 100*b*. The scan driving circuit 100*a* is similar to the scan driving circuit 100 as shown in FIGS. 5 and 6, and will not be described again here. The scan driving circuit 100*b* will be described in detail below.

For example, as shown in FIG. 8, the scan driving circuit 100*b* comprises a third scan unit 31, a third control circuit 33, and a fifth switching circuit 52. The third scan unit 31 comprises a fifth output terminal 55 configured to output a fifth scan signal. The fifth scan signal is the same as the first scan signal, and the fifth scan signal and the first scan signal are used for bilateral driving of the same scan line (e.g, the first scan line). The third control circuit 33 is connected to the fifth switching circuit 52, and the third control circuit 33 is configured to receive the first control signal and control turn-on or turn-off of the fifth switching circuit 52 under control of the first control signal. The first scan line 14 is connected to the fifth output terminal 55 via the fifth switching circuit 52, so that the fifth output terminal 55 is electrically connected to the first scan line 14 when the fifth switching circuit 52 is turned on.

For example, as shown in FIG. 8, the scan driving circuit 100*b* further includes a fifth scan line 54, a fourth control circuit 43, and a sixth switching circuit 62. The third scan unit 31 further comprises a sixth output terminal 65 configured to output a sixth scan signal. The fourth control circuit 43 is connected to the sixth switching circuit 62, and the fourth control circuit 43 is configured to control turn-on or turn-off of the sixth switching circuit 62 under control of the third control signal. The fifth scan line 54 is connected to the sixth output terminal 65 through the sixth switching circuit 62, so that the sixth output terminal 65 is electrically connected to the fifth scan line 54 when the sixth switching circuit 62 is turned on.

For example, as shown in FIG. 8, the scan driving circuit 100*b* further comprises a fourth scan unit 41 and a seventh switching circuit 72. The fourth scan unit 41 comprises a seventh output terminal 75 configured to output a seventh scan signal, and the seventh scan signal is identical to the third scan signal. The third control circuit 33 is connected to the seventh switching circuit 72, and the third control circuit 33 is configured to control turn-on or turn-off of the seventh switching circuit 72 under control of the first control signal. The third scan line 34 is connected to the seventh output terminal 75 via the seventh switching circuit 72, so that the seventh output terminal 75 is electrically connected to the third scan line 34 when the seventh switching circuit 72 is turned on.

For example, as shown in FIG. 8, the scan driving circuit 100*b* further comprises a sixth scan line 64 and an eighth switching circuit 82. The fourth scan unit 41 further comprises an eighth output terminal 85 configured to output an eighth scan signal. The fourth control circuit 43 is connected to the eighth switching circuit 82, and the fourth control circuit 43 controls turn-on or turn-off of the eighth switching circuit 64 under the control of the third control signal. The sixth scan line 64 is connected to the eighth output terminal 85 via the eighth switching circuit 82, so that the eighth output terminal 85 is electrically connected to the sixth scan line 64 when the eighth switching circuit 82 is turned on.

For example, as shown in FIG. 9, similar to the scan driving circuit 100*a*, the fifth switching circuit 52, the sixth switching circuit 62, the seventh switching circuit 72, and the eighth switching circuit 82 in the scan driving circuit 100*b* may comprise a fifth switching transistor, a sixth switching transistor, a seventh switching transistors and eighth switching transistors respectively. The arrangement of each of the switching transistors in the scan driving circuit 100*b* is similar to that of the scan driving circuit 100*a*, and will not be described herein.

For example, as shown in FIG. 9, the third control circuit 33 comprises a third control transistor, a first electrode of the third control transistor is connected to the signal input terminal VDD, a second electrode is connected to a gate electrode of the fifth switching transistor and a gate electrode of the seventh switching transistor, and a gate electrode of the third control transistor is connected to a third control terminal C3 to receive the first control signal. For example, the third control terminal C3 can be connected to the sensor 300 for receiving the first control signal.

It should be noted that in some embodiments, the third control circuit 33 may also only comprise the third control terminal C3 (not comprising the third control transistor). The third control terminal C3 is configured to implement that the gate electrode of the fifth switching transistor is directly connected to the gate electrode of the seventh switching transistor and the sensor 300, so that the first control signal generated by the sensor 300 can be directly input to the gate electrode of the fifth switching transistor and the gate electrode of the seventh switching transistor to control the turn-on and turn-off of the fifth switching transistor and the seventh switching transistor.

For example, as shown in FIG. 9, the fourth control circuit 43 comprises a fourth control transistor, a first electrode of the fourth control transistor is connected to the signal input terminal VDD, a second electrode is connected to a gate electrode of the sixth switching transistor and a gate electrode of the eighth switching transistor, and a gate electrode of the fourth control transistor is connected to a fourth control terminal C4 to receive the third control signal. For example, the fourth control terminal C4 can be connected to the sensor 300 for receiving the third control signal.

It should be noted that in some embodiments, the fourth control circuit 43 may also only comprise the fourth control terminal C4 (not comprising the fourth control transistor). The fourth control terminal C4 is configured to implement that the gate electrode of the sixth switching transistor is directly connected to the gate electrode of the eighth switching transistor and the sensor 300, so that the third control signal generated by the sensor 300 can be directly input to the gate electrode of the sixth switching transistor and the gate electrode of the eighth switching transistor to control the turn-on and turn-off of the sixth switching transistor and the eighth switching transistor.

For example, the third control signal can be used to control the display of the third display area 36. For example, the third control signal can be generated by sensor 300 as shown in FIG. 12.

For example, as shown in FIGS. 8 and 9, the fifth scan line 54 and the sixth scan line 64 correspond to the third display area 36, that is, the fifth scan line 54 and the sixth scan line 64 are respectively connected to two rows of pixel units in the third display area 36 and are respectively used to drive pixel units in a corresponding row to implement the display function.

For example, the third scan unit 31 and the fourth scan unit 41 respectively output the sixth scan signal and the eighth scan signal at the first scan time and the second scan time. The fourth control circuit 43 controls the turn-on of the sixth switching circuit 62 and the eighth switching circuit 82 under the control of the third control signal, so that the sixth scan signal and the eighth scan signal may be transmitted to the third display area 36 via the fifth scan line 54 and the sixth scan line 64, respectively, to implement progressive scan display of the third display area 36.

For example, as shown in FIGS. 8 and 9, the first scan unit 11 and the second scan unit 21 in the scan driving circuit 100*a* are two cascaded shift registers, the third scan unit 31 and the fourth scan unit 41 in the scan driving circuit 100*b* may also be cascaded shift registers. The arrangement of the cascaded shift registers is similar to the arrangement as shown in FIG. 7, and will not be described again here.

For example, as shown in FIGS. 8 and 9, the scan driving circuit 100*a* and the scan driving circuit 100*b* are respectively on the right side of the second display area 26 and the left side of the third display area 36, that is, the driving modes of the second display area 26 and the third display area 36 are unilateral driving; the scan driving circuit 100*a* and the scan driving circuit 100*b* are on both sides of the first display area 16, that is, the driving manner of the first display area 16 is bilateral driving. For example, when the size of the first display area 16 is relatively large, in order to avoid the delay of the scan signal on the scan line, the bilateral driving is required.

In the example, under the control of the first control signal, the scan drive circuit 100*a* and the scan drive circuit 100*b* is controlled to perform the scanning operation on the first display area 16, so as to achieve progressive scan display of the first display area 16. Under the control of the second control signal, the scan driving circuit 100*a* is controlled to perform the scanning operation on the second display area 26, so as to implement progressive scan display of the second display area 26. Under the control of the third control signal, the scan driving circuit 100*b* is controlled to perform the scanning operation on the third display area 36, so as to implement progressive scan display of the third display area 36. In this way, it is possible to display by area according to requirements, thereby reducing power consumption.

In the embodiment of the present disclosure, the first display area 16, the second display area 26, and the third display area 36 may separately display, or any two of them may display at the same time, or three of them may simultaneously display, and the disclosure is not limited thereto.

For example, when the display operation is only performed on the first display area 16, the first control circuit 13 controls the first switching circuit 12 and the third switching circuit 32 to be turned on under the control of the first control signal, and the third control circuit 33 controls the fifth switching circuit 52 and the seventh switching circuit 72 to be turned on under the control of the first control signal. At the first scan time, the first scan unit 11 outputs the first scan signal, the third scan unit 31 outputs the fifth scan signal at the same time, and the first scan signal and the fifth scan signal may be respectively transmitted to the first display area 16 via the two terminals of the first scan line 14; at the second scan time, the second scan unit 21 outputs the third scan signal, the fourth scan unit 41 outputs the seventh scan signal at the same time, and the third scan signal and the seventh scan signal may be transmitted to the first display area 16 via both two terminals of the third scan line 34, respectively. When each of the scan circuit 100*a* and the scan circuit 100*b* comprises a plurality of scan units cascaded together, the working principle of the scan units is deduced by analogy, and details are not described herein again. Therefore, bilateral drive display of the pixel units in a corresponding row of the first display area 16 can be achieved.

When the display operation is only performed on the second display area 26, the second control circuit 23 controls the second switching circuit 22 and the fourth switching circuit 42 to be turned on under the control of the second control signal. The first scan unit 11 outputs a second scan signal at the first scan time, and the second scan unit 21 outputs a fourth scan signal at the second scan time. The second scan signal and the fourth scan signal may be transmitted to the second display area 26 via the second scan line 24 and the fourth scan line 44, respectively. When the scan circuit 100*a* comprises a plurality of scan units cascaded together, the working principle of the scan units is deduced by analogy, and details are not described herein again. Therefore, the progressive scan display of the second display area 26 can be achieved.

When the display operation is only performed on the third display area 36, the fourth control circuit 43 controls the sixth switching circuit 62 and the eighth switching circuit 82 to be turned on under the control of the third control signal. The third scan unit 31 outputs a sixth scan signal at the first scan time, and the fourth scan unit 41 outputs the eighth scan signal at the second scan time. The sixth scan signal and the eighth scan signal may be transmitted to the third display area 36 via the fifth scan line 54 and the sixth scan line 64, respectively. When the scan circuit 100*b* comprises a plurality of scan units cascaded together, the working principle of the scan units is deduced by analogy, and details are not described herein again. Therefore, the progressive scan display of the third display area 36 can be achieved.

When the display operation is performed on the first display area 16 and the second display area 26 simultaneously (the third display area 36 does not display), the first control circuit 13 controls the first switching circuit 12 and the third switching circuit 32 to be turned on under the control of the first control signal, the third control circuit 33 controls the fifth switching circuit 52 and the seventh switching circuit 72 to be turned on under the control of the first control signal, and the second control circuit 23 controls the second switching circuit 22 and the fourth switching circuit 42 to be turned on under the control of the second control signal. At the first scan time, the first scan unit 11 outputs the first scan signal and the second scan signal, and the third scan unit 31 outputs the fifth scan signal at the same time. The first scan signal and the fifth scan signal may be transmitted to the first display area 16 via the two terminals of the first scan line 14, respectively, and the second scan signal may be transmitted to the second display area 26 via the second scan line 24. At the second scan time, the second scan unit 21 outputs the third scan signal and the fourth scan signal, and the fourth scan unit 41 outputs the seventh scan signal at the same time. The third scan signal and the seventh scan signal may be transmitted to the first display area 16 via the two terminals of the third scan line 34, respectively, and the fourth scan signal may be transmitted to the second display area 26 via the fourth scan line 44. When the scan circuit 100*a* and the scan circuit 100*b* each comprises a plurality of scan units that are cascaded together, the working principle of the scan units is deduced by analogy, and details are not described herein again. Therefore, the progressive scan display of the first display area 16 and the second display area 26 (where the driving mode of the first display area 16 is bilateral driving display) can be implemented.

When the display operation is performed on the first display area 16 and the third display area 36 simultaneously (the second display area 26 does not display), the first control circuit 13 controls the first switching circuit 12 and the third switching circuit 32 to be turned on under the control of the first control signal, the third control circuit 33 controls the fifth switching circuit 52 and the seventh switching circuit 72 to be turned on under the control of the first control signal, and the fourth control circuit 43 controls the sixth switching circuit 62 and the eighth switching circuit 82 to be turned on under the control of the third control signal. At the first scan time, the first scan unit 11 outputs the first scan signal, and the third scan unit 31 also outputs the fifth scan signal and the sixth scan signal. The first scan signal and the fifth scan signal may be transmitted to the first display area 16 via the two terminals of the first scan line 14, respectively, and the sixth scan signal may be transmitted to the third display area 36 via the fifth scan line 54. At the second scan time, the second scan unit 21 outputs a third scan signal, and the fourth scan unit 41 also outputs the seventh scan signal and the eighth scan signal. The third scan signal and the seventh scan signal may be transmitted to the first display area 16 via the two terminals of the third scan line 34, respectively, and the eighth scan signal may be transmitted to the third display area 36 via the sixth scan line 64. When each of the scan circuit 100*a* and the scan circuit 100*b* includes a plurality of scan units that are cascaded together, the working principle of the scan units is deduced by analogy, and details are not described herein again. Therefore, the progressive scan display of the first display area 16 and the third display area 36 (where the driving mode of the first display area 16 is bilateral driving display) can be achieved.

When the display operation is performed on the first display area 16, the second display area 26, and the third display area 36 simultaneously, the first control circuit 13 controls the first switching circuit 12 and the third switching circuit 32 to be turned on under the control of the first control signal, the third control circuit 33 controls the fifth switching circuit 52 and the seventh switching circuit 72 to be turned on under the control of the first control signal, the second control circuit 23 controls the second switching circuit 22 and the fourth switching circuit 42 to be turned on under the control of the second control signal, and the fourth control circuit 43 controls the sixth switching circuit 62 and the eighth switching circuit 82 to be turned on under the control of the third control signal. At the first scan time, the first scan unit 11 outputs the first scan signal and the second scan signal, and the third scan unit 31 also outputs the fifth scan signal and the sixth scan signal. The first scan signal and the fifth scan signal may be transmitted to the first display area 16 via the two terminals of the first scan line 14 respectively, the second scan signal may be transmitted to the second display area 26 via the second scan line 24, and the sixth scan signal may be transmitted to the third display area 36 via the fifth scan line 54. At the second scan time, the second scan unit 21 outputs the third scan signal and the fourth scan signal, and the fourth scan unit 41 also outputs the seventh scan signal and the eighth scan signal. The third scan signal and the seventh scan signal may be transmitted to the first display area 16 via the two terminals of the third scan line 34 respectively, the fourth scan signal may be transmitted to the second display area 26 via the fourth scan line 44, and the eighth scan signal may be transmitted to the third display area 36 via the sixth scan line 64. When each of the scan circuit 100*a* and the scan circuit 100*b* comprises a plurality of scan units that are cascaded together, the working principle of the scan units is deduced by analogy, and details are not described herein again. Therefore, the progressive scan display of the first display area 16, the second display area 26, and the third display area 36 (where the driving mode of the first display area 16 is the bilateral driving display) can be implemented.

It should be noted that the number of the display areas as shown in FIG. 8 and FIG. 9 is merely schematic, and the display area may be divided into more display areas according to actual situations, for example, four, five or more, the embodiment of the present disclosure does not limit the number of the display areas. Correspondingly, according to the number of the display areas, a scan driving circuit is provided between adjacent display areas, thereby achieving display by area. The scan driving circuit 100*a* as shown in FIGS. 8 and 9 may comprise a plurality of scan units (not limited to the first scan unit and second scan unit as shown in FIGS. 8 and 9), and the scan driving circuit 100*b* may also comprise a plurality of scan units (not limited to the third and fourth scan units as shown in FIGS. 8 and 9). The present disclosure does not limit the number of the scan units here.

Figure 10:
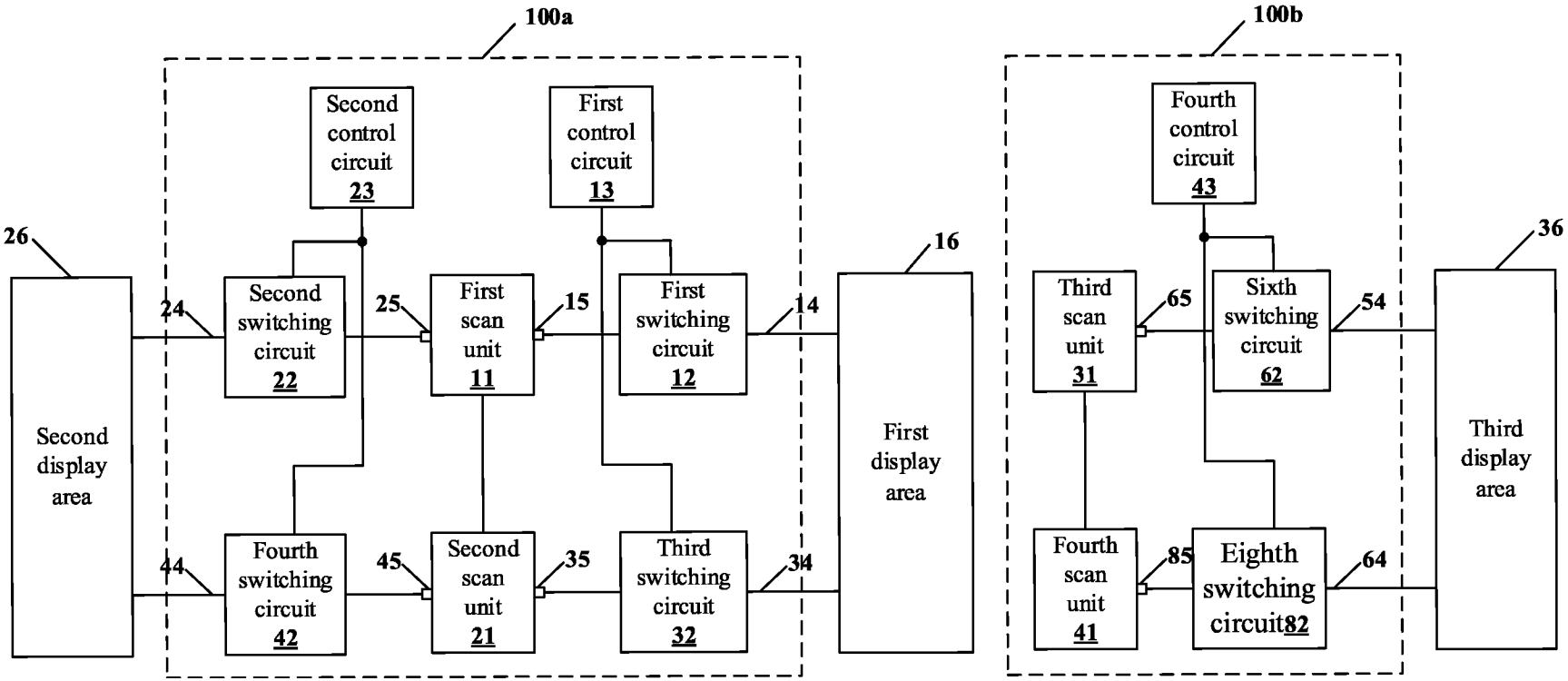
FIG. 10 is a schematic diagram of a scan driving circuit provided by still another example in an embodiment of the present disclosure.
Figure 11:
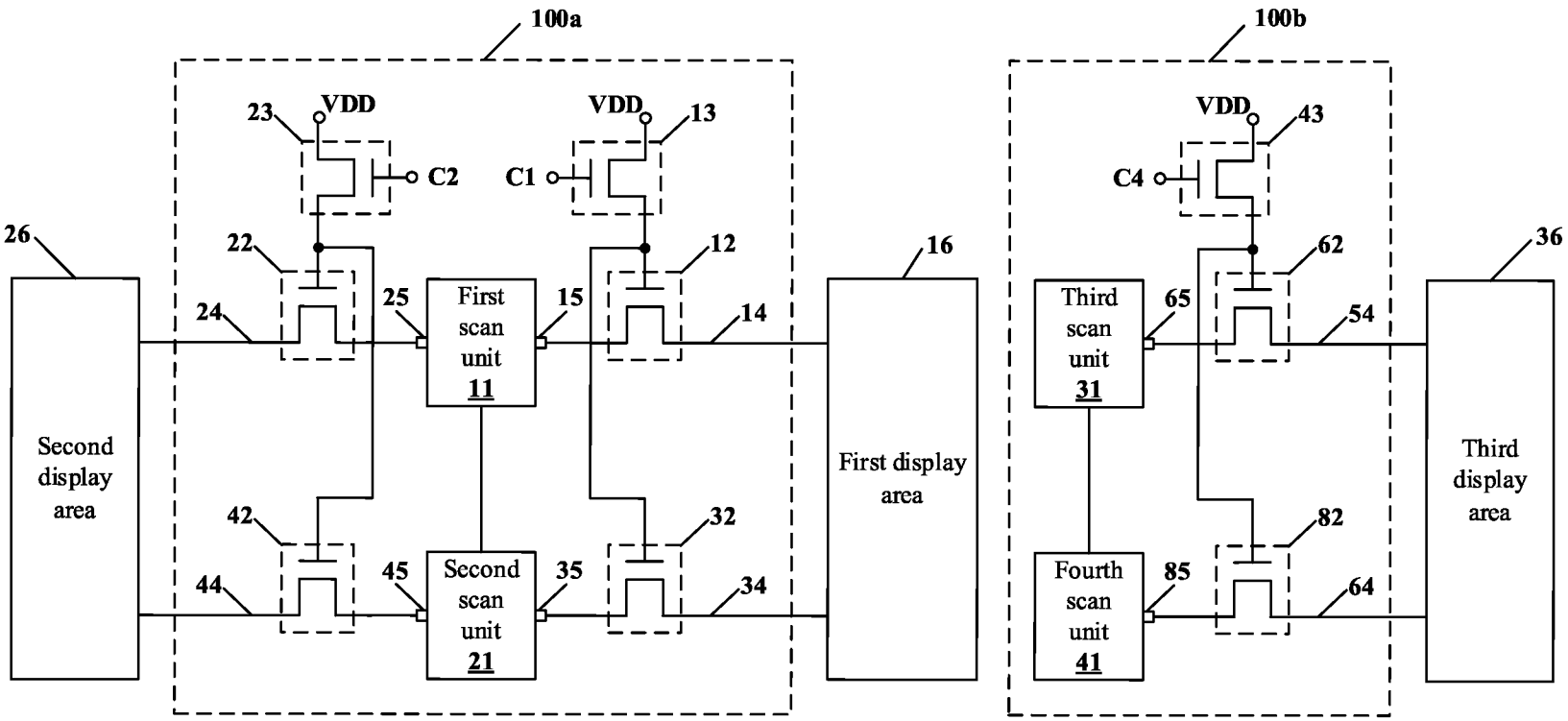
FIG. 11 is an example of a circuit diagram corresponding to the scan driving circuit as shown in FIG. 10.

For example, in another example of an embodiment of the present disclosure, as shown in FIGS. 10 and 11 (FIG. 11 is an example of the circuit diagram of FIG. 10), compared with FIGS. 8 and 9, the scan driving circuit provided by the present example also includes a scan driving circuit 100*a* between the first display area 16 and the second display area 26, and a scan driving circuit 100*b* between the first display area 16 and the third display area 36.

As shown in FIGS. 10 and 11, the present example differs from the examples as shown in FIGS. 8 and 9 in that the scan driving circuit 100*b* in this example is only connected to the third display area 36, and is not connected to the first display area 16. Correspondingly, the third control circuit, the fifth switching circuit, and the seventh switching circuit need not be further provided in the scan driving circuit 100*b*. That is, in the present example, the driving mode of the first display area 16 is unilateral driving. Other descriptions of the scan driving circuit 100*a* and the scan driving circuit 100*b* can refer to the corresponding descriptions as shown in FIGS. 8 and 9, and details are not described herein again.

It should be noted that, the control circuit may not be provided in the scan driving circuit provided by the embodiment of the present disclosure, while the control signal may be directly provided to the switching circuit for controlling the turn-on or turn-off of the switching circuit.

In addition, in the drawings of the embodiments of the present disclosure, the sizes of the scan driving circuit and the display area are merely schematic and do not represent true sizes and proportions.

The embodiment of the present disclosure further provides a display device 500, as shown in FIG. 12, the display device 500 comprises a display panel 200 and any of the above-described scan driving circuits 100.

For example, as shown in FIG. 12, the display device 500 may further comprise a sensor 300. For example, in a case where the display device 500 is a foldable display device, the sensor 300 can be used to determine a folded state of the display device 500. For example, the sensor 300 can include a plurality of sensors for sensing the folded state of the display device. The sensor 300 is configured to generate a control signal for controlling a scanning operation of the display panel 200 according to the folded state of the display device 500. For example, the sensor may be connected to the first control terminal C1, the second control terminal C2, the third control terminal C3, and the fourth control terminal C4 to provide corresponding control signals to respective control terminals.

Figure 13:
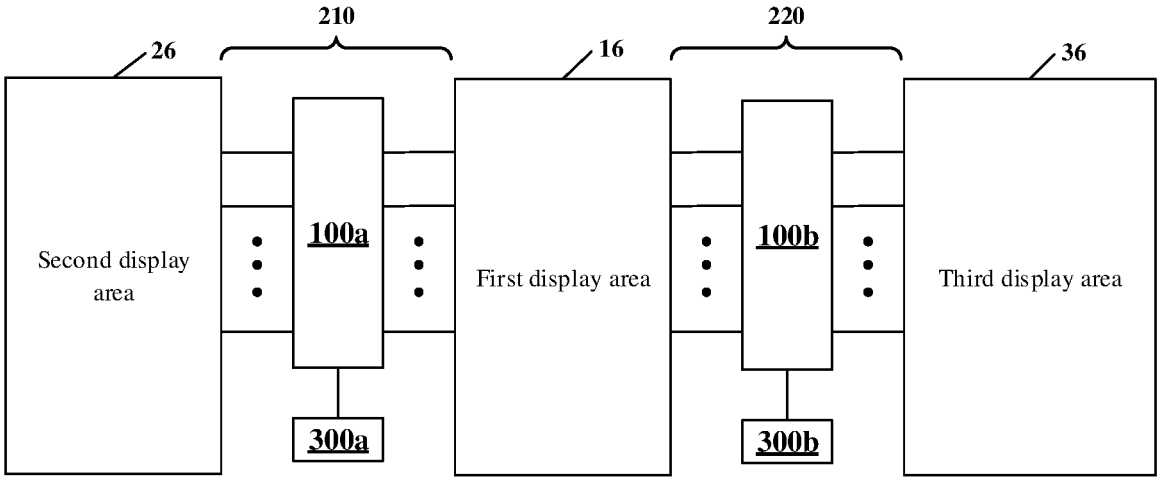
FIG. 13 is a schematic diagram 2 of a display device provided by an embodiment of the present disclosure.

For example, as shown in FIG. 13, the display area of the display panel 200 may be divided into three display areas, which include a first display area 16, a second display area 26, and a third display area 36, respectively, and a foldable area 210 or a foldable area 220 is between the adjacent display areas. For example, the display panel in the foldable area can be made by a flexible material to avoid damage or even breakage when the display panel is folded.

For example, the scan driving circuit 100*a* comprises a plurality of scan units cascaded together, and the scan driving circuit 100*b* also comprises a plurality of scan units cascaded together. The setting of respective scan units, switching circuits, control circuits and corresponding scanning lines can refer to FIG. 8 and FIG. 9, and details are not described herein again.

As shown in FIG. 13, the scan driving circuit 100*a* is disposed in the foldable area 210 between the first display area 16 and the second display area 26, and a sensor 300*a* which can sense the folding operation is correspondingly connected to the scan driving circuit 100*a*, and is configured to respectively provide the first control signal and the second control signal to the first control terminal C1 and the second control terminal C2 in the scan driving circuit 100*a*. Similarly, the scan driving circuit 100*b* is disposed in the foldable area 220 between the first display area 16 and the third display area 36, and a sensor 300*b* which can sense the folding operation is correspondingly connected to the scan driving circuit 100*b*, and is configured to respectively provide the first control signal and the third control signal to the third control terminal C3 and the fourth control terminal C4 in the scan driving circuit 100*b*. It should be noted that the embodiment of the present disclosure does not limit the setting positions of the sensor 300*a* and the sensor 300*b*. The sensor 300*a* and the sensor 300*b* may be at any position on the display device 500 without conflicting with other structures on the display device 500, as long as the folding operation of the display device 500 can be sensed and the control signal can be supplied to the scan driving circuit through the wires.

For example, when the scan driving circuit 100*a* and the scan driving circuit 100*b* adopt a circuit as shown in FIG. 9, and the transistors shown in the drawing are all N-type transistors, the signal input terminal VDD supplies a high level voltage. For example, when the second display area 26 and the third display area 36 are folded, the two display areas are on the back side of the first display area 16, the sensor 300*a* senses the folding operation and generates the first control signal and the second control signal, and the sensor 300*b* senses the folding operation and generates the first control signal and the third control signal. For example, the first control signal is a high level voltage signal that controls the first display area 16 to display, and the second control signal and the third control signal are low level voltage signals that control the second display area 26 and the third display area 36 to display respectively.

It should be noted that embodiments of the present disclosure are not limited to the method that the above-described sensors generate control signals. For example, when the above folding operation is performed, the first control signal, the second control signal, and the third control signal generated are a low level voltage signal, a high level voltage signal, and a high level voltage signal, respectively, thus the first display area 16 does not display and the second display area 26 and the third display area 36 display, so as to meet diverse needs of users.

For example, in another example of an embodiment of the present disclosure, the sensor 300 in the display device 500 can also be sensors of other types. For example, an infrared sensor may be in a peripheral area of each display area of the display device 500. For example, when the folding operation of the display device 500 is performed, the infrared sensor in the periphery area of each display area can sense whether the user's eyes are viewing the current display area. For example, when the user only views the first display area 16, the infrared sensor corresponding to the first display area 16 can sense the user and outputs the first control signal to the scan driving circuit to control the first display area to implement the progressive scan display.

It should be noted that, as shown in FIG. 13, the scan driving circuit 100*a* and the scan driving circuit 100*b* are respectively in the foldable area 210 and the foldable area 220 of the display panel, which may cause dark lines in the foldable area 210 and the foldable area 220. The aperture ratio of the sub-pixels in the display areas adjacent to the scan driving circuit 100*a* and the scan driving circuit 100*b* can be designed to be sufficiently large until the above-described dark lines can be eliminated. Meanwhile, due to the increase of the aperture ratio, the current density required by the corresponding sub-pixels also increases, and a large data signal can be input to the corresponding sub-pixel through an external driving IC, thereby eliminating the dark lines which may be caused due to setting the scan driving circuit.

In addition, because the scan driving circuit 100*a* and the scan driving circuit 100*b* are respectively in the foldable area 210 and the foldable area 220 of the display panel, defects such as mura (display unevenness) may occur, which can be ameliorated by an optical compensation device at the back terminal.

It should be noted that the embodiment of the present disclosure does not limit the type of the display device. For example, the display device may comprise an LCD display panel, and may also comprise an OLED display panel, or other display panels.

In the display device provided by the embodiment of the present disclosure, the scan driving circuit is in the folded area of the display panel, and can be directly integrated on the array substrate of the display device by using the same process as the thin film transistor (TFT). By this way, the frame width can be reduced to achieve the effect of narrow frame. Also, the display device provided by the embodiment of the present disclosure can also display by area according to requirements (for example, only partial regions display after folded), thereby reducing power consumption.

Figure 14:
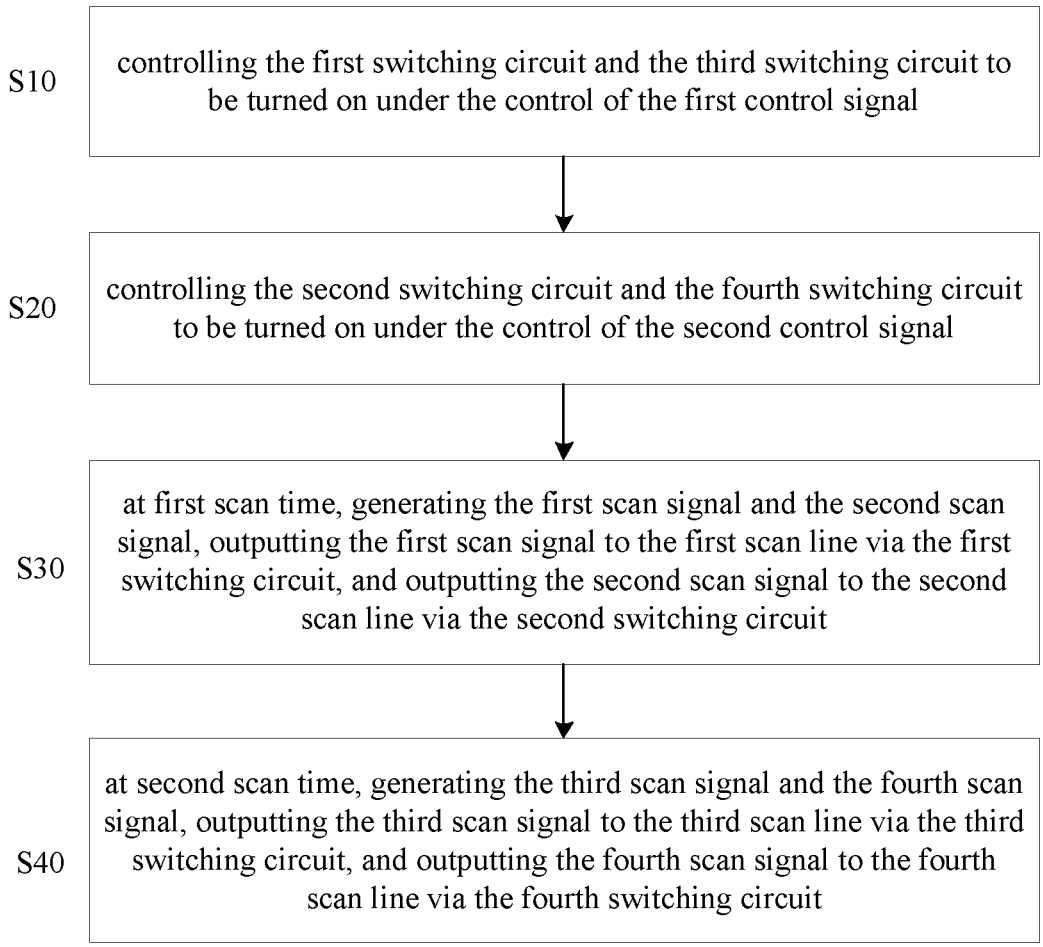
FIG. 14 is a schematic flowchart diagram of a driving method provided by an embodiment of the present disclosure.

An example of an embodiment of the present disclosure also provides a driving method for driving the scan driving circuit as shown in FIGS. 5 and 6. As shown in FIG. 14, the method comprises following operations.

Step S10: controlling the first switching circuit 12 and the third switching circuit 32 to be turned on under the control of the first control signal;

Step S20: controlling the second switching circuit 22 and the fourth switching circuit 42 to be turned on under the control of the second control signal;

Step S30: at first scan time, generating the first scan signal and the second scan signal, outputting the first scan signal to the first scan line 14 via the first switching circuit 12, and outputting the second scan signal to the second scan line 24 via the second switching circuit 22; and Step S40: at second scan time, generating the third scan signal and the fourth scan signal, outputting the third scan signal to the third scan line 34 via the third switching circuit 32, and outputting the fourth scan signal to the fourth scan line 44 via the fourth switching circuit 42.

For example, when the first display area 16 needs to display, step S10, step S30, and step S40 are performed to implement progressive scan display of the first display area 16. When the second display area 26 needs to display, step S20, step S30, and step S40 are performed to implement progressive scan display of the second display area 26. Alternatively, when the first display area 16 and the second display area 26 need to simultaneously display, step S10, step S20, step S30, and step S40 are performed.

It should be noted that when the scan driving circuit includes more scan units and corresponding switching circuits and scan lines, the above driving method correspondingly comprises more operational steps to control more switching circuits and generate more scan signals.

The driving method of this example is performed, thus the progressive scan display of two areas can be separately controlled according to requirements, thereby reducing power consumption.

Figure 15:
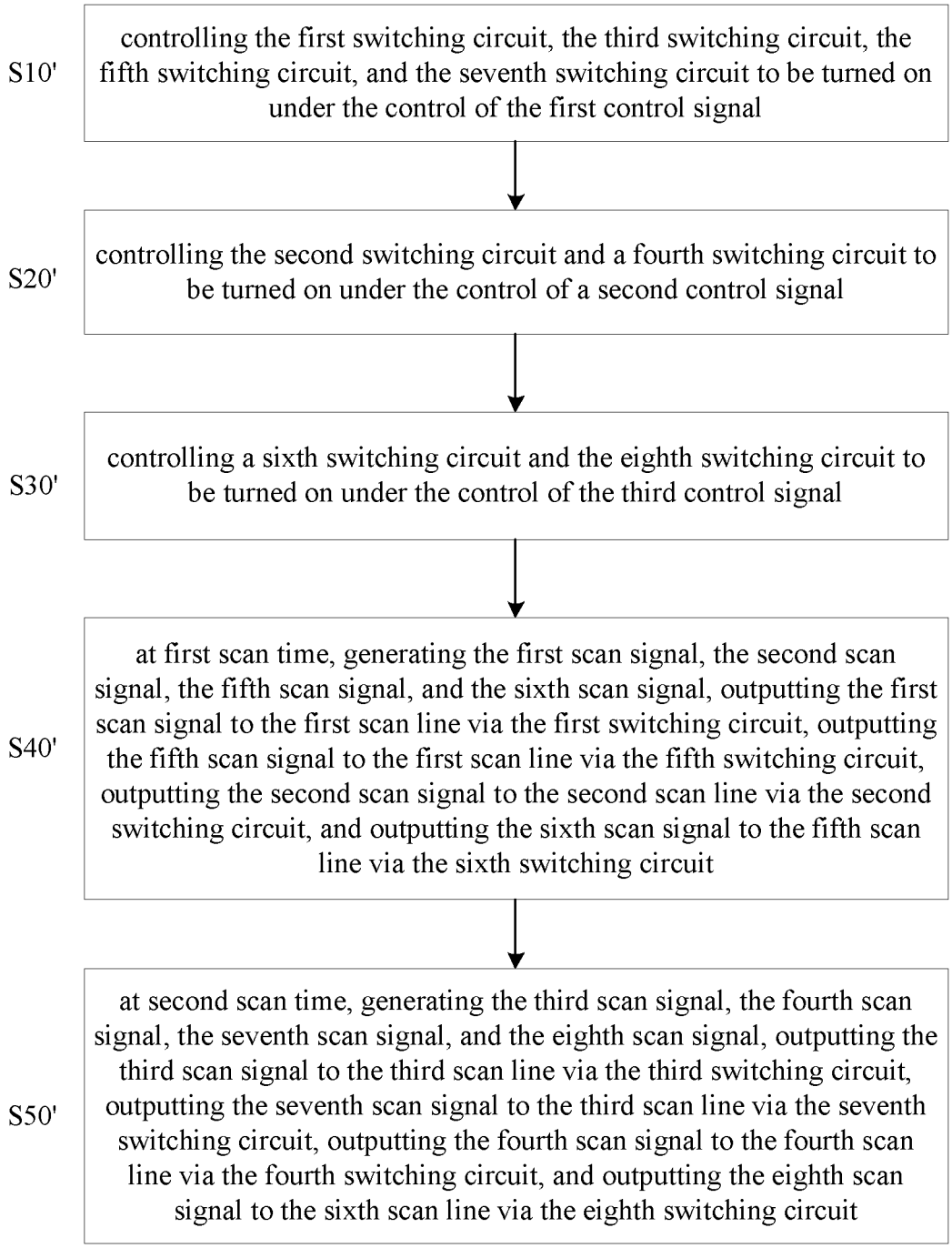
FIG. 15 is a schematic flowchart diagram of another driving method provided by an embodiment of the present disclosure.

For example, another example of an embodiment of the present disclosure also provides a driving method, and the driving method is used for driving a scan driving circuit as shown in FIGS. 8 and 9. As shown in FIG. 15, the method comprises following operations.

Step S10': controlling the first switching circuit 12, the third switching circuit 32, the fifth switching circuit 52, and the seventh switching circuit 72 to be turned on under the control of the first control signal;

Step S20': controlling the second switching circuit 22 and a fourth switching circuit 42 to be turned on under the control of a second control signal;

Step S30': controlling a sixth switching circuit 62 and the eighth switching circuit 82 to be turned on under the control of the third control signal;

Step S40': at first scan time, generating the first scan signal, the second scan signal, the fifth scan signal, and the sixth scan signal, outputting the first scan signal to the first scan line 14 via the first switching circuit 12, outputting the fifth scan signal to the first scan line 14 via the fifth switching circuit 52, outputting the second scan signal to the second scan line 24 via the second switching circuit 22, and outputting the sixth scan signal to the fifth scan line 54 via the sixth switching circuit 62; and Step S50': at second scan time, generating the third scan signal, the fourth scan signal, the seventh scan signal, and the eighth scan signal, outputting the third scan signal to the third scan line 34 via the third switching circuit 32, outputting the seventh scan signal to the third scan line 34 via the seventh switching circuit 72, outputting the fourth scan signal to the fourth scan line 44 via the fourth switching circuit 42, and outputting the eighth scan signal to the sixth scan line 64 via the eighth switching circuit 82.

For example, in a case where the first display area 16 needs to display, step S10', step S40', and step S50' are performed to implement the progressive scan display of the first display area 16. In a case where the second display area 26 needs to display, step S20', step S40', and step S50' are performed to implement the progressive scan display of the second display area 26. In a case where the third display area 36 needs to display, step S30', step S40', and step S50' are performed to implement the progressive scan display of the third display area 36. Or in a case where the first display area 16, the second display area 26, and the third display area 36 needs to simultaneously display, step S10', step S20', step S30', step S40', and step S50' are performed.

It should be noted that embodiments of the present disclosure comprise, but are not limited to, the above display modes. For example, the display of two areas can be implemented in any combination according to requirements, and details are not described herein again.

In addition, when the display panel comprises more display areas, correspondingly, more scan driving circuits need to be provided, and the above driving method correspondingly comprises more operating steps to control the more display areas.

The driving method of this example is performed, thus multiple areas can be separately controlled to display according to requirements, thereby reducing power consumption.

What have been described above are only specific implementations of the present disclosure, the protection scope of the present disclosure is not limited thereto. and the protection scope of the present disclosure should be based on the protection scope of the claims.

What is claimed is:

1. A scan driving circuit, comprising a first scan unit, a first scan line, a first control circuit, and a first switching circuit, wherein the first scan unit comprises a first output terminal configured to output a first scan signal;

the first control circuit is connected to the first switching circuit, and the first control circuit is configured to control turn-on or turn-off of the first switching circuit under control of a first control signal; and the first scan line is directly electrically connected to the first switching circuit, and the first output terminal is directly electrically connected to the first switching circuit, the first scan line is connected to the first output terminal through the first switching circuit, so that the first output terminal is electrically connected to the first scan line when the first switching circuit is turned on.

2. The scan driving circuit according to claim 1, wherein the first switching circuit comprises a first switching transistor, a first electrode of the first switching transistor is connected to the first output terminal, and a second electrode of the first switching transistor is connected to the first scan line; and the first control circuit comprises a first control transistor, a first electrode of the first control transistor is connected to a signal input terminal, a second electrode of the first control transistor is connected to a gate electrode of the first switching transistor, and a gate electrode of the first control transistor is connected to a first control terminal to receive the first control signal.

3. The scan driving circuit according to claim 1, further comprising: a second scan line, a second control circuit, and a second switching circuit, wherein the first scan unit further comprises a second output terminal configured to output a second scan signal;

the second control circuit is connected to the second switching circuit, and the second control circuit is configured to control turn-on or turn-off of the second switching circuit under control of a second control signal; and the second scan line is connected to the second output terminal through the second switching circuit, so that the second output terminal is electrically connected to the second scan line when the second switching circuit is turned on.

4. The scan driving circuit according to claim 3, wherein the second switching circuit comprises a second switching transistor, a first electrode of the second switching transistor is connected to the second output terminal, and a second electrode of the second switching transistor is connected to the second scan line; and the second control circuit comprises a second control transistor, a first electrode of the second control transistor is connected to a signal input terminal, a second electrode of the second control transistor is connected to a gate electrode of the second switching transistor, and a gate electrode of the second control transistor is connected to a second control terminal for receiving the second control signal.

5. The scan driving circuit according to claim 1, further comprising a second scan unit, a third scan line, and a third switching circuit, wherein the second scan unit comprises a third output terminal configured to output a third scan signal;

the first control circuit is connected to the third switching circuit, and the first control circuit is configured to control turn-on or turn-off of the third switching circuit under control of the first control signal; and the third scan line is connected to the third output terminal through the third switching circuit, so that the third output terminal is electrically connected to the third scan line when the third switching circuit is turned on.

6. The scan driving circuit according to claim 5, wherein the first scan line and the third scan line correspond to a first display area, and the first control signal is used to control a scanning operation of the first display area.

7. The scan driving circuit according to claim 5, wherein the first scan unit and the second scan unit are cascaded shift registers.

8. The scan driving circuit according to claim 5, further comprising a fourth scan line and a fourth switching circuit, wherein the second scan unit further comprises a fourth output terminal configured to output a fourth scan signal;

a second control circuit is connected to the fourth switching circuit, and the second control circuit is configured to control turn-on or turn-off of the fourth switching circuit under control of a second control signal; and the fourth scan line is connected to the fourth output terminal through the fourth switching circuit, so that the fourth output terminal is electrically connect the fourth scan line when the fourth switching circuit is turned on.

9. The scan driving circuit according to claim 8, wherein a second scan line and the fourth scan line correspond to a second display area, and the second control signal is used to control a scanning operation of the second display area.

10. The scan driving circuit according to claim 5, further comprising a third scan unit, a third control circuit, and a fifth switching circuit, wherein the third scan unit comprises a fifth output terminal configured to output a fifth scan signal, and the fifth scan signal is identical to the first scan signal;

the third control circuit is connected to the fifth switching circuit, and the third control circuit is configured to receive the first control signal and control turn-on or turn-off of the fifth switching circuit under control of the first control signal; and the first scan line is connected to the fifth output terminal through the fifth switching circuit, so that the fifth output terminal is electrically connected to the first scan line when the fifth switching circuit is turned on.

11. The scan driving circuit according to claim 10, further comprising a fifth scan line, a fourth control circuit, and a sixth switching circuit, wherein the third scan unit further comprises a sixth output terminal configured to output a sixth scan signal;

the fourth control circuit is connected to the sixth switching circuit, and the fourth control circuit is configured to control turn-on or turn-off of the sixth switching circuit under control of a third control signal; and the fifth scan line is connected to the sixth output terminal through the sixth switching circuit, so that the sixth output terminal is electrically connected to the fifth scan line when the sixth switching circuit is turned on.

12. The scan driving circuit according to claim 10, further comprising a fourth scan unit and a seventh switching circuit, wherein the fourth scan unit comprises a seventh output terminal configured to output a seventh scan signal, the seventh scan signal is identical to the third scan signal;

the third control circuit is connected to the seventh switching circuit, and the third control circuit is configured to control turn-on or turn-off of the seventh switching circuit under control of the first control signal; and the third scan line is connected to the seventh output terminal through the seventh switching circuit, so that the seventh output terminal is electrically connected to the third scan line when the seventh switching circuit is turned on.

13. The scan driving circuit according to claim 12, wherein the third scan unit and the fourth scan unit are cascaded shift registers.

14. The scan driving circuit according to claim 12, further comprising a sixth scan line and an eighth switching circuit, wherein the fourth scan unit further comprises an eighth output terminal configured to output an eighth scan signal;

a fourth control circuit is connected to the eighth switching circuit, and the fourth control circuit controls turn-on or turn-off of the eighth switching circuit under control of a third control signal; and the sixth scan line is connected to the eighth output terminal through the eighth switching circuit, so that the eighth output terminal is electrically connected to the sixth scan line when the eighth switching circuit is turned on.

15. The scan driving circuit according to claim 14, wherein a fifth scan line and the sixth scan line correspond to a third display area, and the third control signal is used to control a scanning operation of the third display area.

16. A display device comprising a display panel and the scan driving circuit according to claim 1.

17. The display device according to claim 16, further comprising a sensor for determining a folded state of the display device, wherein the sensor is configured to generate a control signal for controlling a scanning operation of the display panel according to the folded state of the display device.

18. The display device according to claim 16, wherein the scan driving circuit is in a folded region of the display panel.

19. A method for driving the scan driving circuit according to claim 8, comprising:

controlling the first switching circuit and the third switching circuit to be turned on under control of the first control signal;

controlling a second switching circuit and the fourth switching circuit to be turned on under control of the second control signal;

at first scan time:

generating the first scan signal and a second scan signal; and outputting the first scan signal to the first scan line via the first switching circuit, and outputting the second scan signal to a second scan line via the second switching circuit; and at second scan time:

generating the third scan signal and the fourth scan signal; and outputting the third scan signal to the third scan line via the third switching circuit, and outputting the fourth scan signal to the fourth scan line via the fourth switching circuit.

20. A method for driving the scan driving circuit according to claim 14, comprising:

controlling the first switching circuit, the third switching circuit, the fifth switching circuit, and the seventh switching circuit to be turned on under control of the first control signal;

controlling a second switching circuit and a fourth switching circuit to be turned on under control of a second control signal;

controlling a sixth switching circuit and the eighth switching circuit to be turned on under control of the third control signal;

at first scan time:

generating the first scan signal, a second scan signal, the fifth scan signal, and a sixth scan signal; and outputting the first scan signal to the first scan line via the first switching circuit, and outputting the fifth scan signal to the first scan line via the fifth switching circuit, outputting the second scan signal to a second scan line via the second switching circuit, and outputting the sixth scan signal to a fifth scan line via the sixth switching circuit; and at second scan time:

generating the third scan signal, a fourth scan signal, the seventh scan signal, and the eighth scan signal; and outputting the third scan signal to the third scan line via the third switching circuit, and outputting the seventh scan signal to the third scan line via the seventh switching circuit, outputting the fourth scan signal to a fourth scan line via the fourth switching circuit, and outputting the eighth scan signal to the sixth scan line via the eighth switching circuit.

* * * * *